United States Patent [19]

Johnson et al.

[11] Patent Number: 4,565,419

[45] Date of Patent: Jan. 21, 1986

[54] THREADED LAMP ADAPTER SYSTEM WITH SPRING ADAPTER

[75] Inventors: George E. Johnson, Bronxville; Walter Newman, Forest Hills, both of N.Y.

[73] Assignee: Leviton Manufacturing Company, Inc., Little Neck, N.Y.

[21] Appl. No.: 483,347

[22] Filed: Apr. 8, 1983

Related U.S. Application Data

[63] Continuation-in-part of Ser. No. 420,202, Sep. 20, 1982, Pat. No. 4,429,942, which is a continuation of Ser. No. 211,620, Dec. 1, 1980, Pat. No. 4,360,243.

[51] Int. Cl.[4] ..... H01R 13/02

[52] U.S. Cl. ..... 339/154 L; 339/176 L

[58] Field of Search ..... 339/154 L, 154 A, 176 L, 339/177 L, 278 L; 313/318; 192/41 R, 45.1, 45.2, 56 R

[56] References Cited

U.S. PATENT DOCUMENTS

| | | | |
|---|---|---|---|
| 1,193,252 | 8/1916 | Freeman | 339/154 L X |
| 3,228,209 | 1/1966 | Hersey | 464/23 |
| 3,281,620 | 10/1966 | Miller | 339/75 T X |
| 4,183,604 | 1/1980 | Tjornhom, Sr. | 339/154 L X |
| 4,198,112 | 4/1980 | Miller | 339/176 L |
| 4,222,623 | 9/1980 | Hultberg | 339/154 L X |
| 4,360,243 | 11/1982 | Johnson et al. | 339/154 L |

*Primary Examiner*—Eugene F. Desmond
*Assistant Examiner*—Steven C. Bishop
*Attorney, Agent, or Firm*—Paul J. Sutton

[57] ABSTRACT

An adapter for permitting a lamp to be threaded into a light socket while preventing damage to the socket through application of excessive threading force includes a threaded sleeve rotatably mounted on a cylindrical body and conductive securing means for preventing longitudinal movement of the sleeve with respect to the body, the securing means being urged into sliding electrical contact with the sleeve and being connected to an electrical conductor for maintaining electrical continuity between the sleeve and an energizing terminal of the lamp. A cam on the ring cooperates with an opening in the sleeve for permitting relative rotation between the sleeve and body in one direction when a threshold torque is exceeded to prevent damage to the socket but preventing relative rotation in the other direction so that the lamp and adapter can be threaded out of the socket. Another embodiment includes a resilient finger extending from the ring that springs into engagement with a slot formed on the rim of the sleeve and into a cavity in the cylindrical body when the slot is rotated into registry with the finger and the sleeve.

7 Claims, 19 Drawing Figures

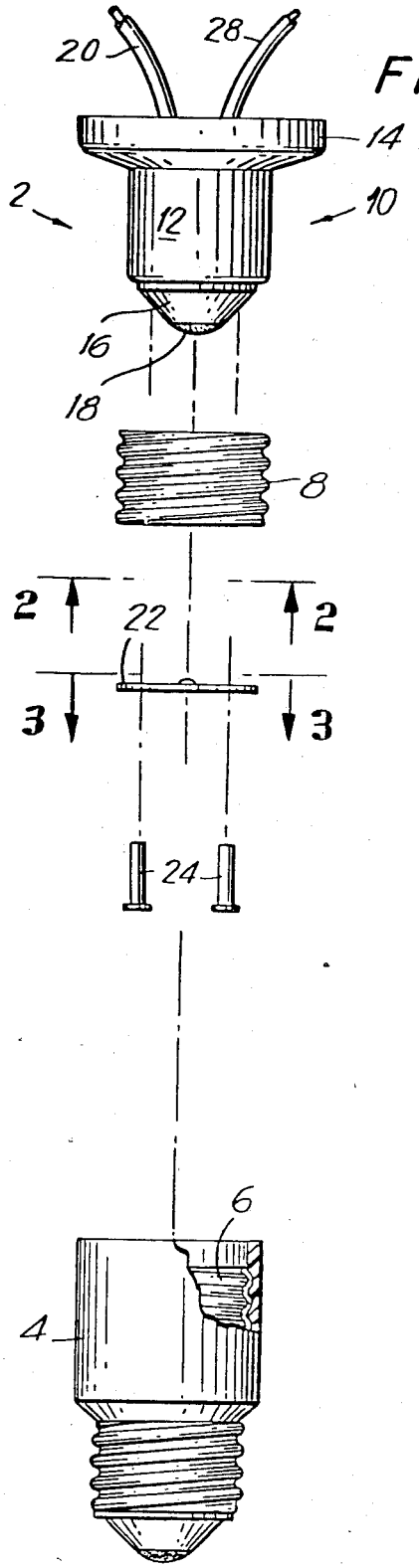
FIG. 1
FIG. 2
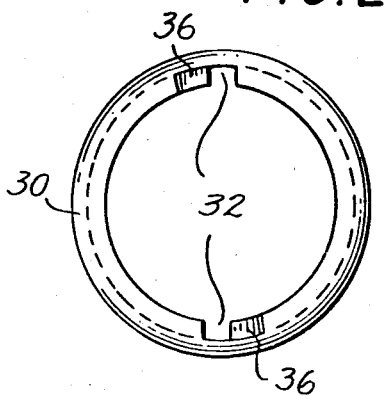
FIG. 3
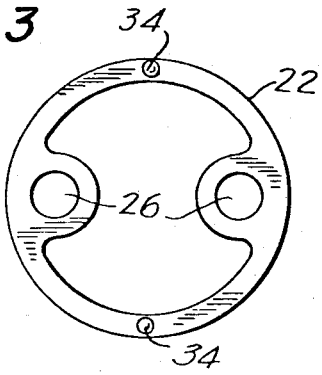
FIG. 4
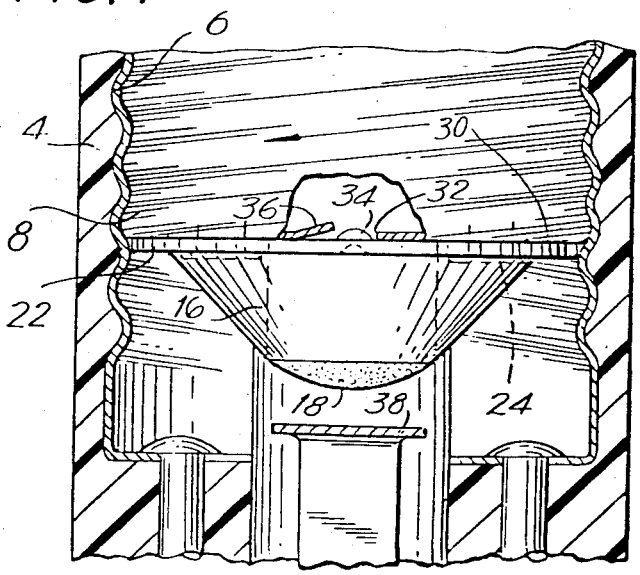

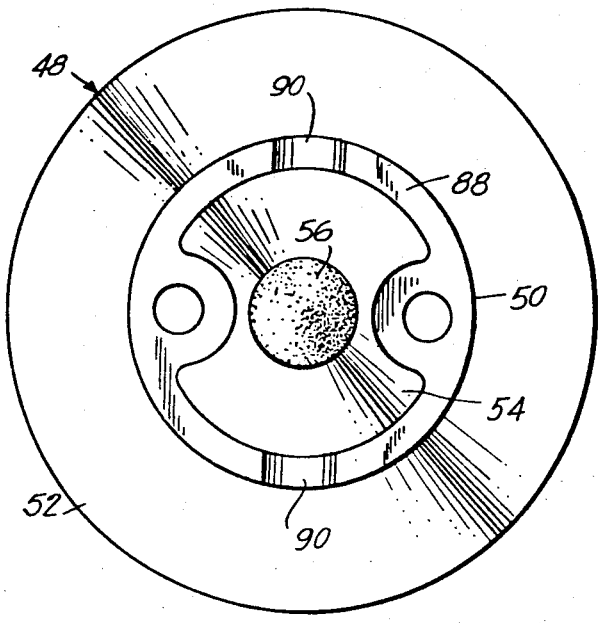
FIG. 14
FIG. 15
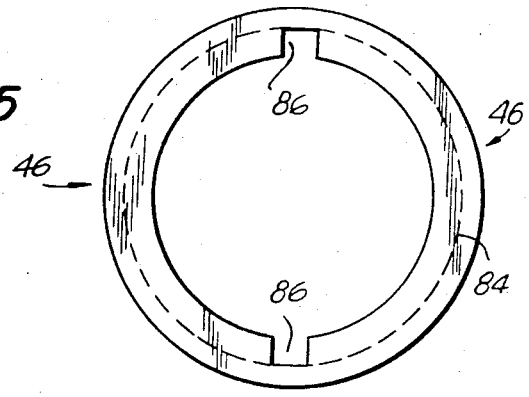
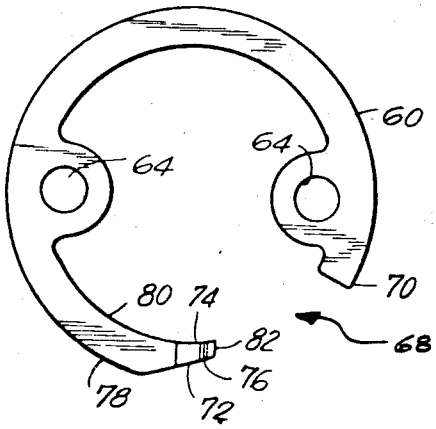
FIG. 16

THREADED LAMP ADAPTER SYSTEM WITH SPRING ADAPTER

This application is a continuation-in-part of application Ser. No. 420,202 filed Sept. 20, 1982, now U.S. Pat. No. 4,429,942, which is a continuation of application Ser. No. Pat. No. 211,620, filed Dec. 1, 1980, now U.S. Pat. No. 4,360,243.

BACKGROUND OF THE INVENTION

The instant invention relates to adapters for permitting electrical lamps to be threaded into light sockets. More specifically, the invention relates to an adapter for permitting an electrical lamp to be threaded into a light socket while protecting against damage to the light socket as a result of excessive torque applied to the lamp during the threading process.

It is known in the art to provide electrical adapters having threads which permit the adapter to be threaded into a correspondingly threaded socket of a light fixture and which have connection means compatible with an electrical lamp which may or may not, by itself, be provided with suitable threads for attachment to the light fixture without the use of an adapter. Some adapters have male threads suitable for engaging the female threads of a standard light socket in a light fixture and female threads suitable for receiving the male threads of a lamp such as an incandescent light bulb. Such adapters sometimes provide an AC receptacle for receiving the male plug of an electrical appliance. Other adapters have a switch or a pull chain and are particularly useful when the light fixture is not provided with its own switch means.

Other adapters are known for use in permitting a lamp which is not, in of itself, compatible with the female threads of a standard light socket to be connected to the socket. The use of fluorescent lamps has become increasingly popular due to the high degree of light output obtainable per unit of electrical power expended and the pleasing color of the light emitted, which, to the human eye, approximates daylight. Adapters are known which include a male threaded connector and supporting members suitable for engaging a fluorescent lamp and effecting electrical communication between the lamp and the power output terminals of the threaded electrical socket.

Exertion of excessive torque or rotational force on a lamp when it is being threaded into a socket often causes damage to the threads of the socket or the supporting body of the socket and sometimes results in jamming between the threaded portions of the lamp and socket which makes it difficult to remove the lamp from the socket without damaging the often fragile glass lamp. This is especially likely where the lamp is a circular fluorescent tube having a diameter much greater than that of common incandescent lamps and therefore causing substantially greater torques to be applied to the lamp socket than is the case with a smaller diameter incandescent bulb when the same rotational force is applied to both.

SUMMARY OF THE INVENTION

The instant invention overcomes the problems of the prior art discussed above in providing an inexpensive adapter which can be permanently connected to an electrical lamp and which has a threaded sleeve rotatably mounted on the body of the adapter for rotation against the force of friction relative to the body. The degree of friction between the sleeve and body is sufficient to permit the threaded portion of the adapter to be threaded into the socket of a light fixture but permits rotation of the threaded portion relative to the body when excessive torque is applied in threading the adapter into the light fixture socket thereby preventing damage to the socket. Resistance means are provided on the body and sleeve to increase the torque which must be applied to effect relative rotation between the body and sleeve for preventing relative rotation when the adapter is threaded out of the socket for removing the lamp.

It is therefore an object of the invention to provide a connector for adapting a lamp to be threaded into a lighting fixture.

Another object of the invention is to provide such a connector which permits the lamp to be rotated relative to the lighting fixture after being fully threaded therein to prevent damage to the fixture due to exertion of excessive torque on the lamp.

Still another object of the invention is to provide such a connector which can be removed from a light fixture socket by rotation of the lamp to which it is connected.

A further object of the invention is to provide such a connector wherein electrical continuity is maintained between the lamp and the threaded portion of the connector which is rotatable relative to the lamp.

Still a further object of the invention is to provide such a connector having integral cooperating means on the threaded portion thereof and the means is for maintaining electrical continuity with the lamp for axially fixing the position of the threaded portion and providing increased resistance to rotation of the threaded portion relative to the body of the adapter when turned in a direction to remove the lamp from a light fixture.

Other and further objects of the invention will be apparent from the following drawings and description of a preferred embodiment of the invention in which like reference numerals are used to indicate like parts in the various views.

DESCRIPTION OF THE DRAWINGS

FIG. 1 is an exploded elevation view of a first preferred embodiment of a connector in accordance with the invention in relation to its intended environment;

FIG. 2 is an axial view of the first embodiment of the invention taken along line 2—2 of FIG. 1;

FIG. 3 is an axial view of the first embodiment of the invention taken along line 3—3 of FIG. 1;

FIG. 4 is a sectional elevation of the first embodiment of the invention as it is being installed in its intended enviornment;

FIG. 14 is an axial view of the third embodiment taken along line 14—14 of FIG. 13;

FIG. 15 is an axial view of the third embodiment taken along line 15—15 of FIG. 13;

FIG. 16 is an axial view of the third embodiment taken along line 16—16 of FIG. 13;

DESCRIPTION OF THE PREFERRED EMBODIMENTS

Figure 5:
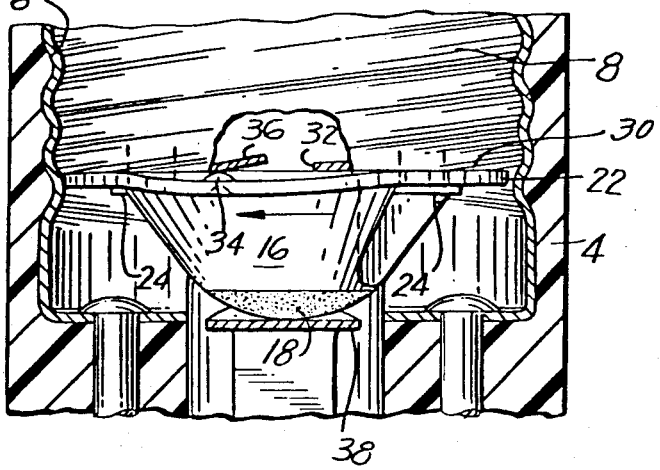
FIG. 5 is a sectional elevation of the first embodiment of the invention after it is installed in its intended enviornment.
Figure 7:
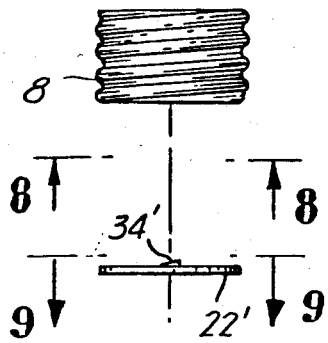
FIG. 7 is an exploded elevational view showing components of a second preferred embodiment of the invention.

Referring now to FIGS. 1, 2, and 3 of the drawings, there is shown in FIG. 1 a connector 2 in accordance with the first preferred embodiment of the invention and an electrical socket 4 which can be a socket of a light fixture which is adapted to receive a standard threaded incandescent light bulb. Socket 4 includes threads 6 within its cylindrical bore which can receive the threads of a standard incandescent light bulb or the threads of a hollow cylindrical sleeve 8 on adapter 2.

Adapter 2 has a body 10 with a smooth cylindrical surface 12 which terminates at one end in an outward tapering circular flange 14 and at the other end in an inward tapering nose portion 16. The cylindrical portion 12, flange 14 and nose portion 16 of body 10 are made of an insulating material which is, in the preferred embodiments of the invention, a hard plastic.

At the tip of nose portion 16 there is an electrical terminal 18 which can be held in place by a rivet. An electrical conductor such as an insulated wire 20 can be connected to terminal 18 at one of its ends and at the other of its ends to one of the energizing terminals of an electrically actuated lamp(not shown).

The threaded cylindrical ring 8 has an inner diameter just slightly greater than the outer diameter of cylindrical surface 12 of body 10 and an axial length just slightly shorter than the axial length of cylindrical portion 12. In the assembled adapter 2 sleeve 8 is mounted on body 10 in circumscribing relationship with cylindrical surface 12, sleeve 8 being rotatable relative to surface 12 about a common axis.

A securing or retaining ring 22 having a diameter substantially equal to the diameter of sleeve 8 is mounted about the end of the cylindrical portion 12 of connector body 10 adjacent nose portion 16 by means of two mounting studs or rivets 24 which are passed through respective apertures 26 formed in retaining ring 22 and then through respective apertures 26 formed in retaining ring 22 and then through respective diametrically opposite cylindrical bores in body 10 having axes displaced from and parallel to the common axis of cylindrical surface 12 and sleeve 8.

Securing ring 22 and studs 24 are, in the preferred embodiments of the invention, made of a conducting material, such as a metal. The ring 22 is urged against sleeve 8 in the axial direction by rivets 24 thereby maintaining ring 22 in electrical contact with sleeve 8. Sleeve 8 is rotatable relative to ring 22 about cylindrical body portion 12. There is a degree of friction between sleeve 8 and body 10, including ring 22, which requires application of a minimum torque to sleeve 8 relative to body 10 for rotation between the sleeve and the body to occur. A second electrical conductor 28 can be connected to ring 22 by means of one or both of rivets 24 as for example by crimping or soldering. This places conductor 28 in electrical contact with sleeve 8 irrespective of the rotational disposition of sleeve 8 with respect to body 10.

The end of sleeve 8 adjacent nose portion 16 of the body 10 extends radially inwardly to form a rim portion or lip 30 which abuts against the surface ring 22. On rim portion 30 are formed two diametrically opposite openings in the form of rectangular notches 32 which are adapted to receive diametrically opposite projections 34 on the surface of ring 22. In the first embodiment of the invention, projections 34 have cam surfaces which are substantially hemispherical.

As sleeve 8 is rotated about cylindrical surface 12 of body 10 with projection 34 out of registration with notches 32, rim portion 30 of the sleeve 8 rides over cam projections 34. As notches 32 come into registration with projections 34 projections 34 are received in notches 32 thereby necessitating the application of increased torque to rotate sleeve 8 relative to ring 22 and, hence, body 10. Upon application of such increased torque the spherical surfaces of projections 34 cause projections 34 to be urged axially away from rim portion 30 as sleeve 8 is rotated relative to body 10. Once out of the notches 32 projections 34 again ride on the rim portion 30 of sleeve 8 thereby lessening the degree of torque required for relative rotation of sleeve 8 with respect to body 10.

The portions of rim 30 immediately adjacent notches 32 in the counterclockwiswise direction in the view of FIG. 2 can be axially recessed thereby forming ramp portions 36. Projections 34 can ride over ramp portions 36 to lessen the degree of torque necessary for rotating sleeve 8 relative to body 10 and ring 22 in the clockwise direction as compared with the degree of torque necessary for rotation of sleeve 8 in the counter-clockwise direction with respect to body 10 as viewed in the direction of the arrows of section line 2—2 in FIG. 1. This construction results in the slippage of sleeve 8 over cylindrical portion 12 of body 10 after sleeve portion 8 is fully threaded into threads 6 of socket 4 to prevent damage to socket 4 and permits sleeve 8 to be threaded out of socket 4 when body 10 is rotated counter-clockwise relative to socket 4 as seen from a view following the direction of the arrows on section line 3—3 in FIG. 1.

The operation of the first preferred embodiment of the invention will now be explained with reference to FIGS. 4, 5, and 6. In FIG. 4, adapter 2 is being threaded into socket 4 and terminal 18 is moving downwardly toward engagement with corresponding socket terminal 38. Although FIG. 4 shows cam projection 34 captured in notch 32, this relative dispositon of projection 34 and notch 32 is not necessary during threading of the adapter into the socket as there will normally be sufficient friction between sleeve 8 and ring 22 to permit the adapter to be threaded into socket 4 without relative rotation between sleeve 8 and body 10.

Figure 6:
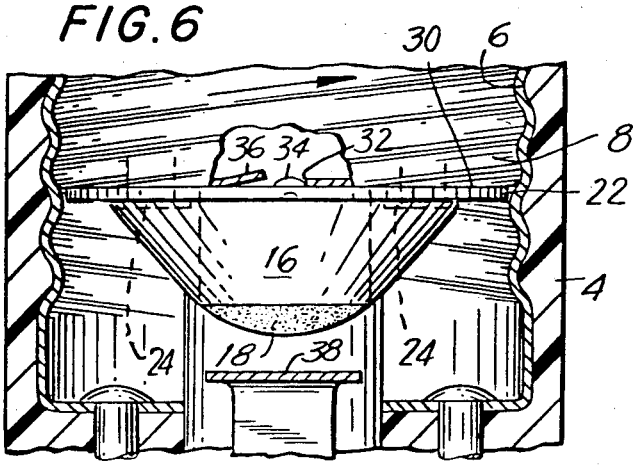
FIG. 6 is a sectional elevation of the first embodiment of the invention as it is being removed from installation in its intended environment.
Figure 8:
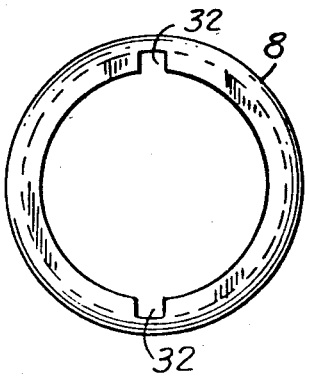
FIG. 8 is an axial view taken through line 8—8 of FIG. 7.

When connector 2 is fully threaded into socket 4 with the terminals 18 and 38 in mutual engagement, as shown in FIG. 5, continuous application of rotational force or torque causes body 10 with ring 22 to rotate relative to sleeve 8 with cam projection 34 passing beneath rim portion 30 adjacent corresponding notch 32. As rotation of the connector is continued, sleeve 8 remains stationary so that no damaging force is applied to socket 4.

When it is desired to remove connector 2 from socket 4, it is rotated counter-clockwise. As shown in FIG. 6, when cam projection 34 comes into registration with a corresponding notch 32, it is captured in notch 32 so that increased resistance to relative rotation between sleeve 8 and ring 22 which is affixed to body 10 is presented. Since the force necessary to turn sleeve 8 is now greater than to the force necessary to turn sleeve 8 relative to threads 6 of socket 4, upon continued counterclockwise rotation of connector body 10 sleeve 8 rotates with it and is threaded out of socket 4 as shown in FIG. 6.

A second preferred embodiment of the invention will now be described with reference to FIGS. 7–12. The second preferred embodiment is similar to the first embodiment with the exception that a ring 22′ is substituted for ring 22 of the first preferred embodiment. Ring 22′ has on its surface projections 34′ comprising cam surfaces in the form of substantially flat sloping truncated ramps. This configuration of projection 34′ facilitates relative rotation between sleeve 8 and ring 22′ when connector 2 is rotated clockwise after being fully threaded into socket 4 and offers increased resistance to relative rotation between sleeve 8 and ring 22′ when connector 2 is rotated counter-clockwise for threading out of socket 4. Since the cam surface of projection 34′ is biased to facilitate relative rotation in the tightening(-clockwise) direction ring 22′ need not be provided with ramp portions adjacent notches 32 although such ramp portions can be included to further facilitate rotation in the tightening direction.

The cam projection 34′ can be formed on ring 22′ by a punching operation whereby a punch is applied to the side of ring 22′ opposite side from which projection 34′ protrudes from it.

Figure 10:
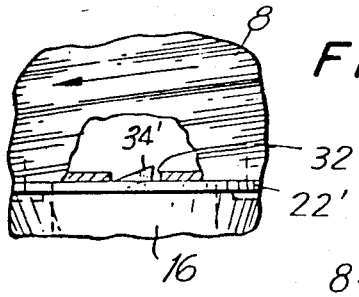
FIG. 10 is a fragmented sectional elevation of the second embodiment of the invention in one disposition after being installed in its intended environment.
Figure 9:
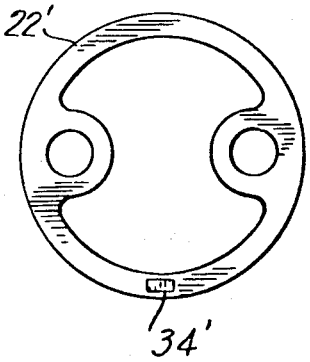
FIG. 9 is an axial view taken through line 9—9 of FIG. 7.
Figure 11:
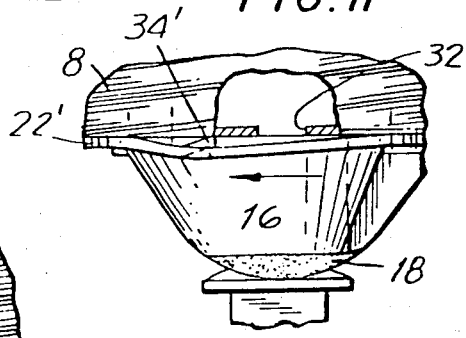
FIG. 11 is a sectional elevation of parts of the second embodiment of the invention in another disposition after installation in its intended environment.
Figure 12:
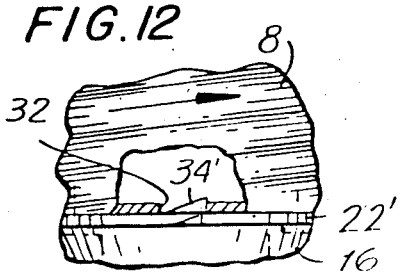
FIG. 12 is a sectional elevation showing parts of the second embodiment of the invention as it is being removed from installation in its intended environment.

As can be seen from FIGS. 10, 11 and 12 the operation of the second preferred embodiment of the invention is similar to that described with respect to the first preferred embodiment. In FIG. 10 cam projection 34′ is captured in notch 32 of ring 22′ as the connector is threaded into a light fixture socket 4.

Once the connector is fully threaded into socket 4 cam projection 34′ slips beneath ring 22′ and sleeve 8 remains stationary as body 10 with ring 22′ affixed to it continues to rotate in response to the applied torque used to thread the connector into socket 4. The torque applied to connector 2 will, often, be applied through the turning of the lamp(not shown) which is fixed to connector 2.

When the connector 2 is to be threaded out of socket 4, it is rotated in the counter-clockwise direction, as shown in FIG. 12, at which time cam projection 34′ is captured in notch 32 and a perpendicular surface of cam projection 34′ engages the edge of notch 32 thereby presenting resistance to relative rotation between sleeve 8 and ring 22′ so that sleeve 8 is rotated with body 10 causing it to be threaded out of socket 4.

A third preferred embodiment of the invention will now be described with reference to FIGS. 13–19. The third preferred embodiment of the invention is similar to the first and second embodiments, but for purposes of clarification, FIGS. 13–19 will be described with added numerals.

Reference is now made to FIGS. 13, 14, 15 and 16. In accordance with the third preferred embodiment of the invention, a connector, or adapter, 40 is illustrated and an electrical socket 42, which can be a socket of a light fixture adapted to receive a standard threaded incandescent light bulb. Socket 42 includes threads 44 within its cylindrical base which can receive the threads of a standard incandescent light bulb or the threads of a hollow cylindrical sleeve 46 on adapter 40.

Adapter 40 has a body 48 with a smooth cylindrical surface, or portion, 50 which terminates at one end in an outward tapering circular flange 52 and at the other end in an inward tapering nose portion 54. The cylindrical portion 50, flange 52, and nose portion 54 of body 10 are made of an insulating material which is, in the preferred embodiments of the invention, a hard plastic.

At the tip of the nose portion 54 there is an electrical terminal 56 which can be held in place by a rivet. An electrical conductor such as an insulated wire 58 can be connected to terminal 56 at one of its ends and at the other of its ends to one of the energizing terminals of an electrically activated lamp(not shown).

Threaded cylindrical sleeve 46 has an inner diameter just slightly greater than the other diameter of cylindrical surface 50 of body 48 and an axial length just slightly shorter than the axial length of cylindrical portion 50. In the assembled adapter 40, sleeve 46 is mounted on body 48 in circumscribing relationship with cylindrical portion 50, with sleeve 46 being rotated relative to portion 50 about a common axis.

A securing, or rotating, ring 60 having a diameter equal to the diameter of sleeve 46 is mounted about the end of cylindrical portion 50 of connector body 40 adjacent to nose portion 54 by means of two mounting studs or rivets, 62 which are passed through respective apertures 64 formed in retaining ring 60 and then through diametrically opposite cylindrical bores in body 48 having axes displaced from and parallel to the common axis of cylindrical portion 50 and sleeve 46.

Retaining ring 60 and rivets 62 are made of a resilient conductive material, such as metal. Ring 60 is urged against sleeve 46 in the axial direction by rivets 62 thereby maintaining ring 60 in electrical contact with sleeve 46. Sleeve 46 is rotatable relative to ring 60 about cylindrical body portion 50. There is a degree of friction between sleeve 46 and body 40, which includes ring 60, which requires application of a minimum torque to sleeve 46 relative to body 48 for rotation between the sleeve and body to occur. A second electrical conductor 66 can be connected to ring 60 by means of one or both of rivets 62, for example, by crimping or soddering. This places conductor 66 in electrical contact with sleeve 46 irrespective of the rotational disposition of sleeve 46 with respect to body 48.

Retaining ring 60 forms a cutout 68 that breaks the continuity of the circularity of the ring. Cutout 68 is located between a first cutout end portion 70 and a second cutout end portion 72, which is spaced a short angular distance from the first cutout end portion. An inclined, or ramped, finger 74 extends from ring 60 at second cutout end portion 72 towards sleeve 46. Finger 74 extends from end portion 72 within the circular plane of ring 60. As shown in FIG. 16, finger 74 preferably includes a tapered portion 76 that extends inwardly from the outer diameter 78 towards the inner diameter 80 of ring 60. Finger 74 includes a short, flat tip 82 at its end most position. Finger 74, like ring 60, is made of a resilient material.

As shown in FIG. 15, the end of sleeve 46 adjacent nose portion 54 of body 48 extends radially inwardly to form a lip, or rim portion, 84 which abuts against the surface of ring 60. Two diametrically opposed rectangular slots 86 are formed on rim portion 84. Slots 86 are adapted to receive inclined finger 74 of ring 60. As will be made clear later, finger 74 is capable of extending into a corresponding slot 86 during rotation of sleeve 46 relative to body 48 which is secured to ring 60.

Figure 13:
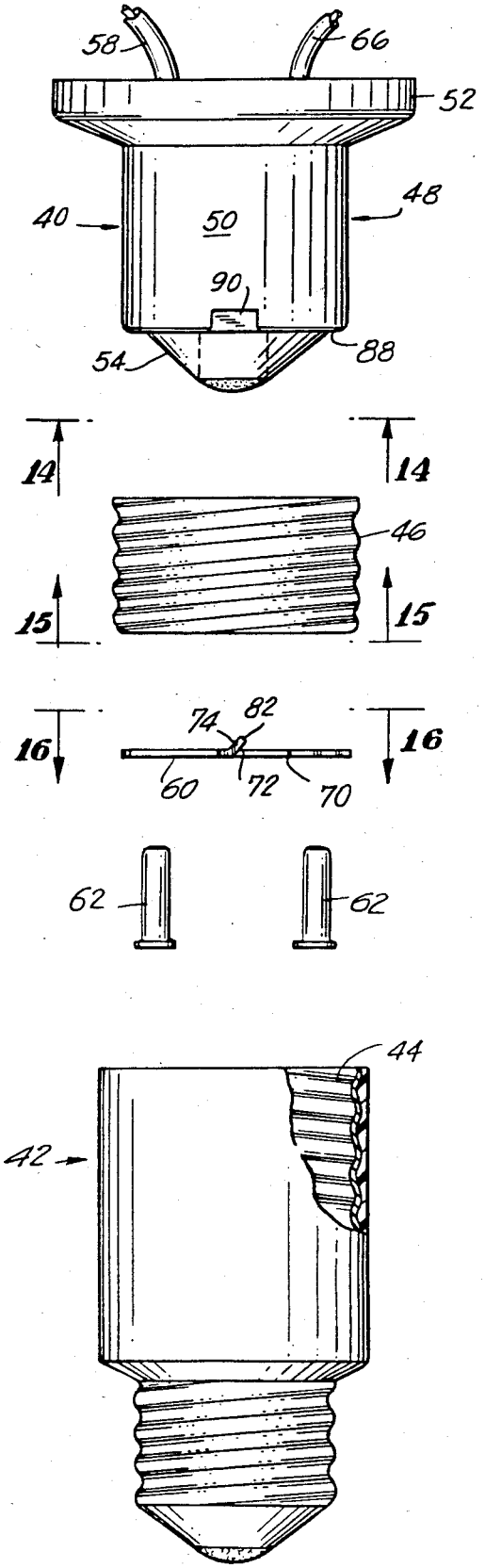
FIG. 13 is an exploded elevation view of a third preferred embodiment of a connector in accordance with the invention in relation to its intended environment.

As shown in FIGS. 13 and 14, a circular mounting base 88 configured by body 48 between cylindrical portion 50 and nose portion 54 is adapted to seat rim portion 84 of sleeve 46. At least one cavity 90 is formed by body 48 at cylindrical portion 50. Cavity 90 is in registry, or alignment, with inclined finger 74. A second cavity 90 is formed by body 48 at cylindrical portion 50 diametrically opposed to cavity 90. Second cavity 90 is a convenience that can be used during assembly of adapter 40 instead of cavity 90 if in fact finger 74 is assembled in registry with cavity 90'.

As body 48 is rotated clockwise within socket 42 and in addition is turning clockwise relative to sleeve 46 with finger 74 out of registry with a corresponding slot 86, inclined finger 74 rides under, or against, rim portion 84 of sleeve 46. When corresponding slot 86 comes into registration with inclined finger 74, finger 74 is received into corresponding slot 86 with which it comes into registry. When finger 74 passes into the corresponding slot 86 in registry with the finger, tip 82 of the finger passes into cavity 90 of body 48.

Finger 74 is inclined away from the direction of continuous rotation of body 48 relative to socket 42 when body 48 is being threaded into socket 42 and threads sleeve 46 engage with threads 44 of socket 42, with the result that sleeve 46 is threaded into socket 42, and after sleeve 46 is fully engaged in socket 42, body 48 will rotate relative to sleeve 46 and to socket 42. Furthermore, the inclination of finger 74; besides being away from clockwise rotational threading of body 48 into socket 42, is also towards the counterclockwise rotation dethreading of body 48 from socket 42 in the opposite direction so that finger 74 becomes locked into a corresponding slot 86 and into cavity 90 and so causes sleeve 46 to rotate with body 48 and to be threaded out of socket 42. When body 48 is rotated clockwise into socket 42, finger 74, being resilient, tends to bend slightly when it is withdrawn from a position within slot 86 and cavity 90 along with the base portion of its connecting area with ring 60. Finger 74 moves back into corresponding slot 86 and cavity 90 upon registry with slot 86 with a springing action because of its resilient quality. During the period when finger 74 is not engaged within corresponding slot 86 and cavity 90, tip 82 of finger 74 rides upon rim portion 84 of sleeve 46.

The positioning of finger 74 through a corresponding slot 86 into cavity 90 necessitates the application of increased torque to rotate body 48 with ring 60 relative to sleeve 46. Upon application of such increased torque, the inclined surface of finger 74 tends to cause finger 74 to be urged, or slid, axially out of the slot in which it is positioned and away from rim portion 84 as body 48 is rotated relative to sleeve 46.

Once finger 74 has been slid out of the particular slot and out of cavity 90, finger 74 again rides under, or against, rim portion 84 of sleeve 46 thereby lessening the degree of torque required for relative rotation of body 48 with respect to sleeve 46.

Figure 17:
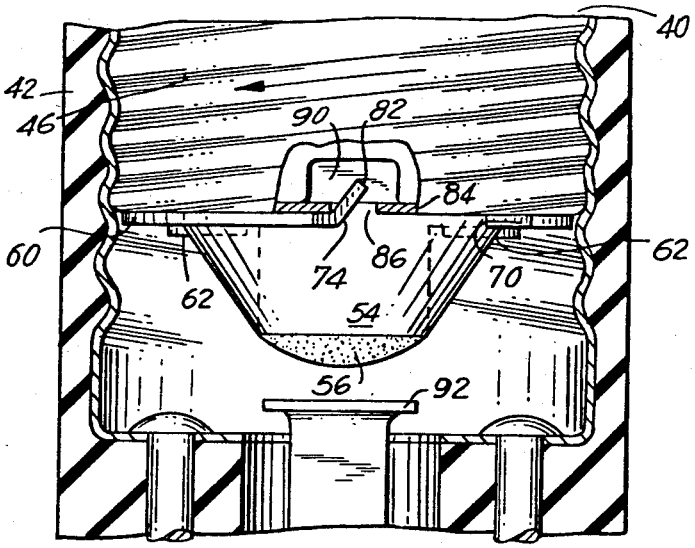
FIG. 17 is a sectional elevation of the third embodiment of the invention as it is being installed in its intended environment.

The operation of the third preferred embodiment of the invention will now be explained with reference to FIGS. 17, 18, and 19. In FIG. 17, adapter 40 is being threaded clockwise into socket 42 and terminal 56 is moving downwardly toward engagement with the corresponding socket terminal 92. Although FIG. 17 shows finger 74 captured in corresponding slot 86 and cavity 90, this relative disposition of finger 74 with corresponding slot 86 and cavity 90 is not necessary during threading of adapter 40 into socket 42 as there will normally be sufficient friction between sleeve 46 and ring 60 to permit adapter 40 to be threaded into socket 42 without relative rotation between sleeve 46 and body 48.

Figure 18:
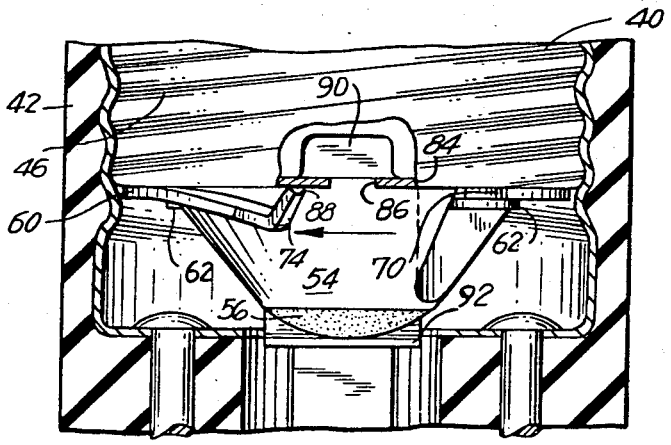
FIG. 18 is a sectional elevation of the third embodiment of the invention after it is installed in its intended environment.
Figure 19:
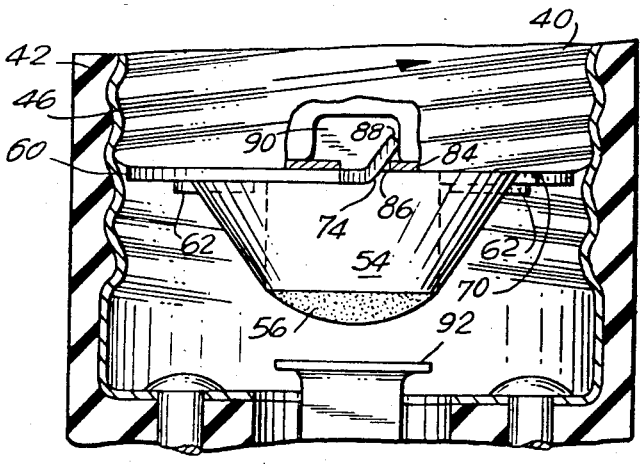
FIG. 19 is a sectional elevation of the third embodiment of the invention as it is being removed from its intended environment.

When adapter 40 is fully threaded into socket 42 with terminals 56 and 92 in mutual engagement, as shown in FIG. 18, continuous application of rotational force or torque causes body 48 with ring 60 to rotate relative to sleeve 46 with finger 74 passing beneath rim portion 84 adjacent to corresponding slot 86. As rotation of the adapter is continued, sleeve 46 remains stationary so that no damaging force is applied to socket 42.

When it is desired to remove adapter 40 from socket 42, adapter 40 is rotated counterclockwise. As shown in FIG. 19, when finger 74 comes into registration with a corresponding slot 86, finger 74 is captured in slot 86 and cavity 90 so that increased resistance to relative rotation between sleeve 46 and ring 60 affixed to body 48 is presented. In the particular configuration of the third embodiment and as shown in FIG. 19, because finger 74 is extended against the angle of inclination relative to the direction of application of counterclockwise torque, finger 74 is pressed more tightly against rim portion 84 as the counterclockwisw application of torque continues so that sleeve 46 is in fact locked with ring 60 and body 48 while adapter 40 is threaded out of socket 42 as shown in FIG. 19.

It is to be appreciated that the invention has been described with reference to three preferred embodiments to which variations can be made without departing from the spirit and scope of the invention which is to be limited only by the following claims.

What is claimed is:

1. A connector for adapting a lamp to be threaded into a lighting fixture comprising:

a body adapted to receive first electrical conductor means connectable to an energizing terminal of said lamp, a sleeve having threads at least on its exterior surface for connection to a threaded light socket and rotatably mounted on said body, said connector including retaining means for limiting axial movement between said body and said sleeve, first resistance means on said body member, and second resistance means on said sleeve member, said first and second resistance means operating to increase the torque necessary to rotate said sleeve in a predetermined disposition relative to said body, said first electrical conducting means being connected to said retaining means, said retaining means being conductive and urged against said sleeve for maintaining electrical contact with said sleeve said sleeve is rotated relative to said body, said first resistance means being formed on said retaining means, said second resistance means including at least one slot formed by said retaining means and at least one cavity formed by said body, said slot and said cavity being capable of coming into registry when said sleeve is rotated relative to said body, said retaining means including a resilient material and said first resistance means includes a resilient finger in registry with said cavity and capable of springing into engagement with said slot and said cavity when said retaining means is rotated relative to said sleeve and said slot and said cavity come into registry.

2. Apparatus according to claim 1, wherein said finger is inclined in a direction that permits said finger to be disengaged from said slot and said cavity upon application of a predetermined torque directed clockwise on said body during threading of said sleeve to said threaded light socket.

3. Apparatus according to claim 2 wherein the inclination of said finger further causes said finger to become locked into said slot and said cavity upon application of a torque directed counterclockwise on said body during unthreading of said sleeve from said threaded light socket.

4. A connector for adapting a lamp to be threaded into a socket of a lighting fixture comprising:

a cylindrical body portion adapted to receive first and second conductors to be connected to the energizing terminals of said lamp, a hollow cylindrical sleeve adapted to be electrically connected to one of said conductors and threaded at least on its exterior for connection to said light socket in said fixture and rotatably mounted on said body for relative rotation with respect thereto about a common axis, said sleeve having a circular rim portion extending about one end of said sleeve, and a securing ring fixedly mounted on one end of said body and slidably engaging said rim portion of said sleeve for permitting relative rotation but limiting axial movement between said sleeve and said body, said ring being adapted for connection to the other of said conductors, said ring forming a cutout and having an inclined finger extending from one side of said cutout within the circular plane of said ring, said body portion forming a circular mounting base adapted to receive said ring, said body forming a cavity at said mounting base in registry with said finger and capable of receiving said finger, said rim portion of said sleeve forming a slot capable of receiving said finger when said slot comes into registry with said finger and said cavity permitting said finger to pass through said slot into said cavity, said finger being inclined away from the direction of continuous rotation of said body relative to said socket when said body is being threaded into said socket and said sleeve threads engage said socket whereby said sleeve will be threaded into said socket and after said sleeve is fully engaged in said socket said body will rotate relative to said sleeve and to said socket, and whereby when said body is being rotated in the opposite direction against the inclination of said finger said finger will become locked into said slot and said cavity and cause said sleeve to rotate with said body and to be threaded out of said socket.

5. Apparatus according to claim 4 wherein said ring is conductive and is urged against said rim portion of said sleeve for maintaining electrical contact with said sleeve as said sleeve is rotated relative to said body and said ring.

6. Apparatus according to claim 5 wherein said finger includes a tip, said tip riding against said rim portion of said sleeve until said tip comes into registry with said slot.

7. Apparatus according to ciaim 4 wherein said ring and said finger are made of a resilient material, whereby said finger springs into said slot and said cavity when said slot is moved into registry with said finger and said cavity.

* * * * *